United States Patent [19]

Fisher

[11] Patent Number: 4,725,336

[45] Date of Patent: Feb. 16, 1988

[54] REFINER APPARATUS WITH INTEGRAL STEAM SEPARATOR

[75] Inventor: C. Donald Fisher, Muncy, Pa.

[73] Assignee: SWM Corporation, Muncy, Pa.

[21] Appl. No.: 696,925

[22] Filed: Jan. 31, 1985

[51] Int. Cl.[4] ..... D21B 1/12; D12D 1/30

[52] U.S. Cl. ..... 162/261; 112/23; 241/244

[58] Field of Search ..... 162/261, 18, 47, 23; 241/244, 261.2

[56] References Cited

U.S. PATENT DOCUMENTS

| | | | |
|---|---|---|---|
| 4,082,233 | 4/1978 | Reinhall | 241/244 |
| 4,118,207 | 10/1978 | Wilhelm | 55/338 |
| 4,148,616 | 4/1979 | Winters | 55/226 |
| 4,221,343 | 9/1980 | Skeen | 241/251 |
| 4,253,857 | 3/1981 | Fisher | 55/400 |
| 4,301,974 | 11/1981 | Sjobom | 241/244 |
| 4,350,499 | 9/1982 | Lundgren | 241/247 |
| 4,600,475 | 7/1986 | Reinhall et al. | 162/261 |

FOREIGN PATENT DOCUMENTS

| | | |
|---|---|---|
| 84/03313 | 8/1984 | PCT Int'l Appl. . |
| 84/03526 | 9/1984 | PCT Int'l Appl. . |
| 8300961 | 3/1985 | Sweden . |

*Primary Examiner*—S. Leon Bashore
*Assistant Examiner*—K. M. Hasting

[57] ABSTRACT

A pressurized disc type refiner having parallel discs housed inside a pressurized chamber and a fluid conveying passageway for removing refined fibrous material entrained in steam is equipped with a second fluid conveying passageway. Fins on the one of the rotating discs impede the entrance of refined fibrous material into the second passageway by centrifugal force so that the steam conveyed in that passageway will be substantially free of entrained fibrous material.

6 Claims, 1 Drawing Figure

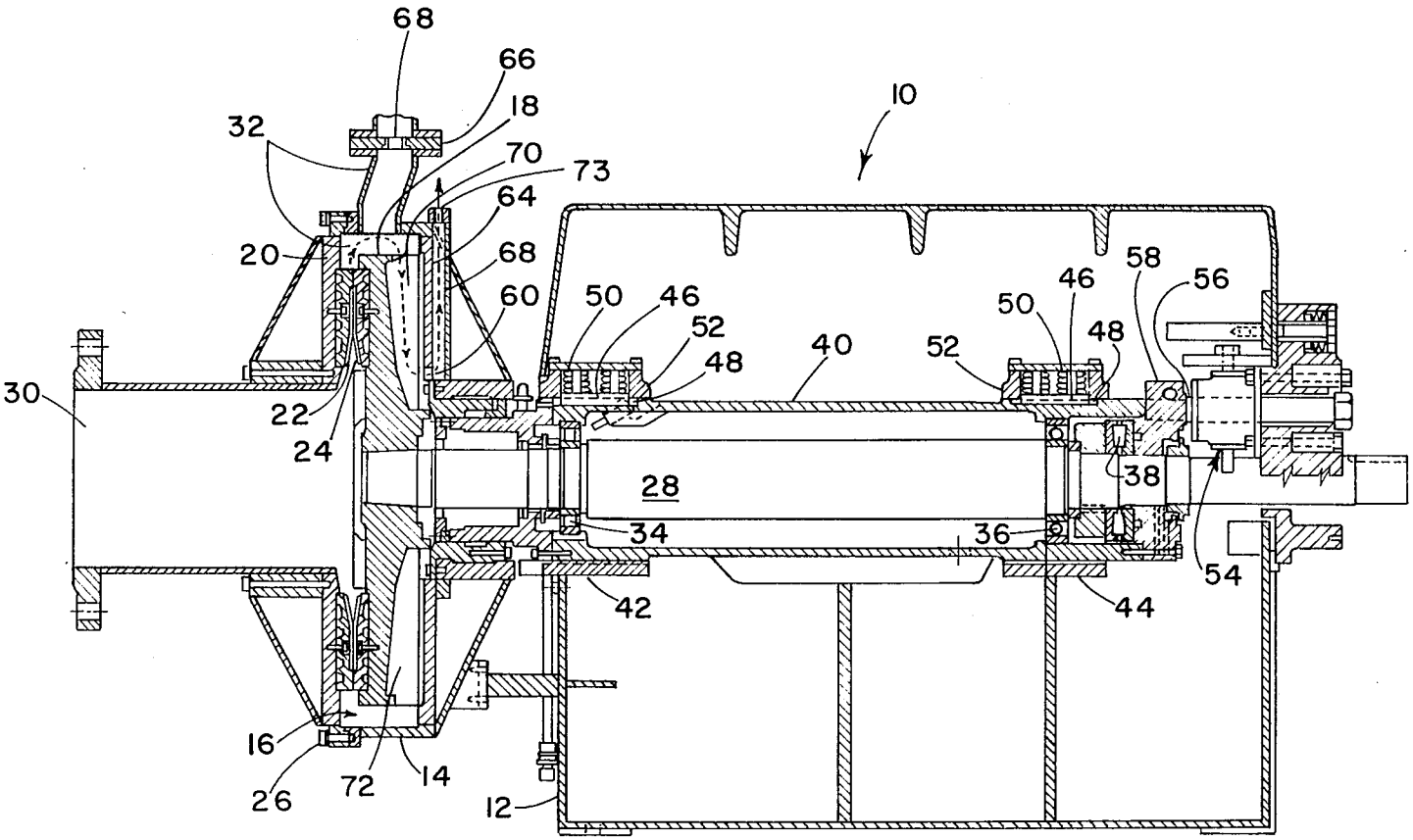
10
12
14
16
18
20
22
24
26
28
30
32
34
36
38
40
42
44
46
48
50
52
54
56
58
60
64
66
68
70
72
73

REFINER APPARATUS WITH INTEGRAL STEAM SEPARATOR

BACKGROUND OF THE INVENTION

1. Field of the Invention

The present invention relates to pulp and paper making apparatus and in particular to pressurized disc-type refiners for reducing wood chips and like materials to pulp.

2. Brief Description of the Prior Art

One type of apparatus used in the production of wood pulp is the so called pressurized disc-type refiner. In this type of apparatus a pair of opposed parallel discs having attrition elements on their adjacent faces are adapted for relative rotation with respect to each other and are enclosed in a pressurized housing. The discs may each to be rotated in opposite directions, or one disc may be fixed while the other is rotated.

Wood chips or like material to be refined are usually introduced between the plates at their centers and are refined by being advanced across the closely spaced attrition elements by centrifugal force and generated steam. Free steam is generated by this refining process, and adjacent to the outer peripheral edge of the discs the refined material is discharged along with this steam through a port in the refiner.

This steam is typically at a pressure from about 15 to 200 pounds per square inch. Thus, it may be used for a number of heating purposes in the paper mill such as for heating the drying rolls on a paper machine. It is, of course, necessary that this high pressure steam be separated from the reduced fibrous material before it can be used in this manner, and several devices are presently in use for this purpose. Centrifugal devices such as a standard centrifugal cyclone are, for example, commonly employed to effect such separation. In an alternative kinetic energy device, a fan impellar enclosed in a pressurized housing throws the heavier fibrous material to the outer perimeter of the housing from where it is then discharged. The lighter steam recovered passes through the center of the housing from where it is recovered for use elsewhere in the paper will.

It will be appreciated that the above described means for separating steam from fibrous material require certain auxiliary equipment which may be costly both in terms of its initial procurement and the plant space which it then consumes. It is, therefore, the object of the present invention to provide a means for separating high pressure steam from fibrous material which avoids these disadvantages.

SUMMARY OF THE INVENTION

In the present invention, an integral steam separator is incorporated into a pulp refiner apparatus. In this apparatus, a conventional pressurized, disc-type refiner is equipped with a second fluid conveying means which diverges from the fluid conveying means containing the stream of steam and refined fibrous material which is discharged from the discs. Means fixed to a rotating disc for impeding the entrance of refined fibrous material into this second fluid conveying means are provided adjacent the mouth of this second fluid conveying means so that the steam removed in this second fluid conveying means is substantially free of refined fibrous material and is suitable for use as high pressure steam elsewhere in the paper mill. A preferred means for impeding the entrance of refined fibrous material into this second fluid conveying means is a plurality of fins positioned adjacent the mouth of this second fluid conveying means and on the outer periphery of a rotating disc. Considerable centrifugal force would be generated by the rotating disc. Thus it would be unlikely that significant amounts of the particulate fibrous material would enter the second fluid conveying means since any solids tending to follow the gas component in that direction would have to overcome that centrifugal force.

BRIEF DESCRIPTION OF THE DRAWINGS

The present invention is further described with reference to the accompanying drawing which is a vertical cross sectional view of a pressurized disc-type refiner apparatus embodying the present invention.

DETAILED DESCRIPTION

Referring to the drawing, a pressurized refiner generally designated 10 as shown includes a base 12 supporting a pressurized housing 14. Within the refining chamber 16 defined by the housing 14 are disposed a first and second parallel spaced refiner discs 18 and 20.

Disc 18 rotates about its central horizontal axis while disc 20 is stationary. It will be understood, however, that the invention described herein can be readily adapted to refiners in which both discs are rotatable. Refining plates 22 and 24 are fixed, respectively, to the confronting faces of discs 18 and 20. As can be seen in the drawing, disc 18 is of solid, substantially unperforated construction.

The plates, which conventionally comprise precisely machined and balanced sets of plate segments, are characterized by attrition elements such as ribs or teeth on their working faces.

The disc 20 is secured by bolts 26 to the housing 14 and is thus fixed in position within the refining chamber 16. The disc 18 is mounted on one end of the drive shaft 28 for rotatin therewith. To vary the spacing between the plates 22 and 24 and hence the refining action of the plates, the shaft 28 is axially adjusted as will be presently described. Material to be refined is introduced axially between the refining plates through the axial inlet passage 30 and is discharged from the refining chamber through the radial discharge fluid conveying passageway 32.

The shaft 28 is journaled by roller bearing 34, ball bearing 36 and thrust bearing 38 within a quill 40 which is slidably disposed on quill support members 42 and 44 of the base. Rotation of the quill is prevented by keys 46 cooperating with keyways 48 in the quill, the keys being spring loaded by springs 50 disposed within the spring retainer assemblies 52 attached to the quill supported members.

The quill 40 and hence the shaft 28 and attached disc 20 and plate 24 are axially positioned by means of a positioning device 54 mounted on the base 12. In the present instance, the positioning device comprises a motor driven worm acting on the threaded positioning stud 56 secured to the arm 58 attached to the outer end of the quill 40. The keyways 48 are elongated to permit a predetermined range of axial movement of the quill and shaft. The shaft extends beyond the quill and the base and is connected with a suitable power source such as an electric motor (not shown).

It should be understood that the above described features of a pressurized, disc-type refiner apparatus are essentially conventional and do not in themselves describe the invention herein. Other equivalent arrangements to accomplish the above described functions are also possible.

Referring again to the drawings, it will be noted that a second fluid conveying passageway 60 diverges from the first fluid conveying passageway 32. This second fluid conveying passageway connects the first fluid conveying passageway 32 with an orifice 73 on the outside of the pressurized housing 14 which is, in turn, connected with a tube 64. It will also be noted that a plate 66 having a central orifice 68 is positioned across the first fluid conveying passageway 32. Circumferentially arranged around the outer peripheral edge of the rotating disc 18 there are a plurality of radial fins as at 70 and 72. It will be noted that these fins are positioned so that as disc 18 rotates past the opening of the second fluid conveying passageway so as to centrifugally impede the entrance of heavy refined fibrous material into the second fluid conveying passageway. The entrance of the lighter steam into the second fluid conveying passageway will not, however, be sufficiently impeded by these moving fins so that steam entering this passageway from the first fluid conveying passageway will be substantially free of fibrous refined material. This clean, high pressure steam will thus be suitable for use in other parts of the paper mill. The path of this stream from the first fluid conveying passageway 32 to the second fluid conveying passageway then into the tube 64 and through orifice 73 for transport to other parts of the paper mill is shown in the broken line in the figure. It will be appreciated that the relative amount of steam diverted from the first fluid conveying passageway 32 into the second fluid conveying passageway 60 will be controlled by selecting particular relative sizes for the orifices 73 and 68. Normally sufficient steam for transporting the discharged refined material would be maintained in the first fluid conveying passageway 32 while steam in excess of that required for transport of the refined fibrous material would be diverted to the second fluid conveying passageway 60.

Although the invention has been described herein with a certain degree of particularity, it is to be understood that the present disclosure has been made only as an example and that the scope of the invention is defined by what is hereinafter claimed.

What is claimed is:

1. In a pressurized refiner for refining wood chips and like materials comprising a housing adapted for pressurization, first and second juxtaposed refiner discs each of said discs having outer peripheral edges and having refiner plates with attrition elements on opposed refining faces thereof and said first disc being of solid, substantially unperforated construction and having a rear side opposite its refining face, and said discs being disposed in parallel closely spaced relation within said housing and said first disc rotatably mounted about its central horizontal axis to refine material passing between said discs, means for introducing material to be refined into said housing and between said discs and a first fluid conveying means positioned radially outwardly from the outer peripheral edges of said discs for discharging refined material from between said discs and out of said housing in a stream of steam and refined material through a first outlet from the housing which is in communication with said first fluid conveying means wherein the improvement comprises a second fluid conveying means diverging adjacent the outer peripheral edge of said first disc from said first fluid conveying means and extending radially inwardly therefrom along the rear side of the first disc such that the first disc is positioned in downstream relation to the second disc with reference to the flow of fluid in said second fluid conveying means, a second outlet from the housing which is in communication with said second fluid conveying means and fins positioned on said rear side of the first disc for centrifugally impeding the flow of refined material into said second fluid conveying means to separate refined material from steam such that steam substantially free of fibrous material is discharged through said second fluid conveying means and second outlet from the housing.

2. The pressurized refiner defined in claim 1 wherein the first fluid conveying means extends first radially outwardly from the discs then laterally adjacent the outer peripheral edge of the first disc then again radially outwardly and wherein the second fluid conveying means diverges from said first fluid conveying means adjacent the outer peripheral edge of the first disc and extends radially inwardly thereform along the rear side of the first disc such that an opening of said second fluid conveying means is formed rearwardly adjacent the outer peripheral edge of the first disc and wherein the fins extend axially from the rear side of the first disc at least partially across said opening.

3. The pressurized refiner defined in claim 1 wherein the second refiner disc is stationary.

4. The pressurized refiner defined in claim 1 wherein the second refiner disc is rotatably mounted about its central horizontal axis.

5. The pressurized refiner defined in claim 1 wherein the second outlet from the housing is positioned rearwardly of the first disc.

6. The pressurized refiner defined in claim 1 wherein the fins are radially arranged on the rear side of the first disc.

* * * * *